US006347883B1

(12) United States Patent
Ekholm

(10) Patent No.: US 6,347,883 B1
(45) Date of Patent: Feb. 19, 2002

(54) APPARATUS FOR ADDING A FIRST FLUID INTO A SECOND FLUID WITH MEANS TO PREVENT CLOGGING

(75) Inventor: Rolf Ekholm, Karlstad (SE)

(73) Assignee: Kvaerner Pulping AB (SE)

( * ) Notice: Subject to any disclaimer, the term of this patent is extended or adjusted under 35 U.S.C. 154(b) by 0 days.

(21) Appl. No.: 09/479,459

(22) Filed: Jan. 6, 2000

(30) Foreign Application Priority Data

Jan. 26, 1999 (SE) ..... 9900220

(51) Int. Cl.[7] ..... B01F 5/06

(52) U.S. Cl. ..... 366/160.1; 366/167.1; 366/176.2

(58) Field of Search ..... 366/151.1, 152.1, 366/160.1, 162.1, 167.1, 173.1, 173.2, 174.1, 176.1, 176.2, 181.5, 336, 338, 340; 162/57, 243

(56) References Cited

U.S. PATENT DOCUMENTS

| | | | | |
|---|---|---|---|---|
| 45,369 | A | * | 12/1864 | Maitland |
| 1,140,548 | A | * | 5/1915 | Vogelsang |
| 1,496,345 | A | * | 6/1924 | Lichtenthaeler |
| 1,519,371 | A | * | 12/1924 | Farnsworth |
| 1,702,373 | A | * | 2/1929 | Alexander |
| 1,826,776 | A | * | 10/1931 | Gunther |
| 1,848,122 | A | * | 3/1932 | Forster |
| 1,992,581 | A | * | 2/1935 | Reeder |
| 2,429,297 | A | * | 10/1947 | Rudolph |
| 2,516,684 | A | * | 7/1950 | Doull et al. |
| 2,563,002 | A | * | 8/1951 | Bissell et al. |
| 2,740,616 | A | * | 4/1956 | Walden |
| 2,747,844 | A | * | 5/1956 | Slayter |
| 2,777,467 | A | * | 1/1957 | Powell et al. |
| 2,784,948 | A | * | 3/1957 | Pahl et al. |
| 2,951,061 | A | * | 8/1960 | Gomory |
| 3,147,717 | A | * | 9/1964 | Smith |
| 3,167,305 | A | * | 1/1965 | Backx et al. |
| 3,190,618 | A | * | 6/1965 | Katzen |
| 3,208,829 | A | * | 9/1965 | Terenzi |
| 3,219,483 | A | * | 11/1965 | Goos et al. |
| 3,266,437 | A | * | 8/1966 | Blackmore et al. |
| 3,307,567 | A | * | 3/1967 | Gogarty et al. |
| 3,332,442 | A | * | 7/1967 | Reed |
| 3,409,274 | A | * | 11/1968 | Lawton |
| 3,475,508 | A | * | 10/1969 | King |
| 3,698,430 | A | * | 10/1972 | Van Gasselt et al. |
| 3,712,341 | A | * | 1/1973 | Constantin et al. |
| 3,734,111 | A | * | 5/1973 | McClintock |
| 3,818,938 | A | * | 6/1974 | Carson |

(List continued on next page.)

FOREIGN PATENT DOCUMENTS

| | | | |
|---|---|---|---|
| DE | 3325969 | A1 | 1/1985 |
| FI | 92417 | * | 7/1994 |

*Primary Examiner*—Charles E. Cooley
(74) *Attorney, Agent, or Firm*—Fasth Law Offices; Rolf Fasth

(57) ABSTRACT

The apparatus is used for adding a first fluid to a second fluid. The apparatus has a tube-shaped element. The tube-shaped element has a flow-through channel defined therein for carrying the flow of the second fluid. The flow-through channel has, a substantially constant first cross-sectional area and maintains a first pressure. The apparatus has a chamber defined therein that extends about the tube-shaped element and along a length of the tube-shaped element. The chamber maintaining a second pressure that is greater than the first pressure. A connection supplies the first fluid to the chamber. The tube-shaped element has a plurality of openings defined therein. The openings are disposed adjacent to the chamber so that the first fluid flows through the openings into the second fluid flowing inside the tube-shaped element. A second conduit is attached to the tube-shaped element and directly downstream thereof. The second conduit has a second cross-sectional area that is greater than the first cross-sectional area.

16 Claims, 2 Drawing Sheets

U.S. PATENT DOCUMENTS 3,866,886 A * 2/1975 Thorne et al.
4,043,539 A * 8/1977 Gilmer et al.
4,053,142 A * 10/1977 Johannes
4,123,800 A * 10/1978 Mazzei
4,189,243 A * 2/1980 Black
4,398,827 A * 8/1983 Dietrich
4,416,610 A * 11/1983 Gallagher, Jr.
4,474,477 A * 10/1984 Smith et al.
4,761,077 A * 8/1988 Werner
4,789,244 A * 12/1988 Dunton et al.
4,954,147 A * 9/1990 Galgon
5,004,484 A * 4/1991 Stirling et al.
5,131,757 A * 7/1992 Smith
5,333,952 A * 8/1994 Perdue
5,338,113 A * 8/1994 Fissenko
5,366,288 A * 11/1994 Dahllof et al.
5,425,581 A * 6/1995 Palm
5,452,955 A * 9/1995 Lundstrom
5,492,404 A * 2/1996 Smith
5,556,200 A * 9/1996 Ekholm et al.
5,597,236 A * 1/1997 Fasano
5,743,637 A * 4/1998 Ogier
5,793,831 A * 8/1998 Tsiklauri et al.

* cited by examiner

APPARATUS FOR ADDING A FIRST FLUID INTO A SECOND FLUID WITH MEANS TO PREVENT CLOGGING

TECHNICAL FIELD

The invention relates to an apparatus for adding a first fluid into a second fluid that flows in a conduit. The apparatus has a tube shaped element having a flow-through channel for the second fluid that has a substantially constant cross sectional area. The apparatus has one or many chambers that extend about at least a major portion of the circumference of the flow-through channel along at least a portion of the lengthwise extension of the channel. The apparatus has a connection for inputting the first fluid into the chamber from a pressure source wherein a series of through holes are disposed in the tubular shaped element in the area of the one or many chambers. The first fluid can be conveyed through the holes into the second fluid that flows through the flow-through channel under the influence of the pressure difference between the chamber and the flow-through channel.

BACKGROUND AND SUMMARY OF THE INVENTION

Apparatuses of the type mentioned above are known through, for example, SE 468 341 and SE 502 393. The apparatus that is described in SE 502 393 is mostly used as a mixer in bleaching facilities in the cellulose industry for mixing in steam into a pulp suspension to raise its temperature to a level that is desirable for a certain reaction to take place at the desired rate in the subsequent bleaching step. The apparatus can provide good mixing of steam into the suspension, but it is difficult to control the amount of steam that is mixed to control the temperature without reducing the effectiveness of the mixing at the same time. The steam mixing is conventionally controlled by using valves on the steam conduit to the chamber. When the steam inflow is reduced to reduce the steam addition, the pressure in the chamber is also reduced and therefore the pressure difference between the inside of the chamber and the pulp suspension in the conduit. This leads, in turn, to reducing the speed of the steam when it enters the flow through conduit of the pulp and therefore the penetration of the steam into the pulp suspension is also reduced.

Typical for SE 468 341 is that the flow-through channel is shaped as a narrow, ring shaped passage for the second fluid which is believed to promote the mixing effect. Without taking a standpoint whether this is correct or not, or if it applies under certain conditions, it can be concluded that the construction has certain practical problems. This should have something to do with the first fluid, when it with a high speed is injected into the second fluid that flows through the narrow channel, interacts with the constricted body that is arranged in the flow-through conduit and that, probably due to resonance phenomena, causes a serious vibration in the apparatus.

Another drawback of the known apparatuses is that the holes for adding steam become clogged up after some use. This is probably mostly due to scaling, i.e. deposits that are built up on the inner walls of the holes, but also the shape of the inlet holes have some effect. Scaling means that a ceramic-like hard coating is formed downstream of the inlet holes of the steam and the coating requires a substantial amount of mechanical treatment to be removed. Alternatively, a chemical treatment, such as acid washing, can be used to remove the deposits. This requires regular intervals of service wherein the pulp flow is shut off and the deposits are chipped away. Scaling takes place at a higher temperature especially when mixing in steam into pulp from hardwood. The deposits mainly consist of calcium carbonate. As may be realized, the clogging of the openings makes it problematic to add a desired amount of steam and there will be problems related to supplying a controlled amount of steam.

Yet another drawback with the known apparatuses is that an uneven temperature distribution in the pulp suspension along the steam conduit is obtained. Sometimes a temperature differential of about 10° C. has been measured between the upper and lower point in a cross section in the subsequent conduits. It is obviously a great drawback to have great temperature differential when working with bleaching chemicals that are often very temperature sensitive, such as hydroperoxide. Furthemore, known apparatuses are relative heavy. Because the material is normally stainless steel, and when the apparatuses also are relatively difficult to manufacture, the total cost of the apparatuses is correspondingly high.

The object of the invention is to provide an apparatus that does not have the above mentioned limitations and drawbacks.

More particularly, the invention relates to an apparatus that provides a good mixing of the first medium into the second medium while providing a good heat distribution of the subsequent conduits, that is, that there are very small temperature differences in an arbitrary selected cross section of the subsequent conduit.

Another positive effect of the apparatus is that is causes relative insignificant vibrations.

Another object is that the need for maintenance is minimized.

Yet another object is that the mixer can be used in very carbonate or calcium rich environments.

These and other objects can be achieved of the apparatus that is described in the appended patent claims. Other characteristics and aspects and advantages of the invention are described in the description below of a preferred embodiment.

BRIEF DESCRIPTION OF THE DRAWINGS

In the description below of a preferred embodiment the attached drawings are referred, of which

DESCRIPTION OF A PREFERRED EMBODIMENT

The apparatus that is going to be described below is developed and intended to be used particularly for mixing in of steam into a suspension of cellulosic fibers (pulp) in a transport conduit for pulp in a bleaching section of a cellulose facility to pre-heat the pulp to a desired temperature that is suitable for the subsequent bleaching step. The principle of the invention can also be used for apparatuses for mixing in of other fluids than steam into a second fluid, such as mixing in chemicals, preferably in a gas phase such as oxygen gas, chlorine gas, perhaps also ozone, or for mixing in of a liquid, such as a pH adjusted liquid, chlorine dioxide or another treatment liquid or dilution liquid in the second fluid, that does not necessary have to be a pulp suspension.

Figure 1:
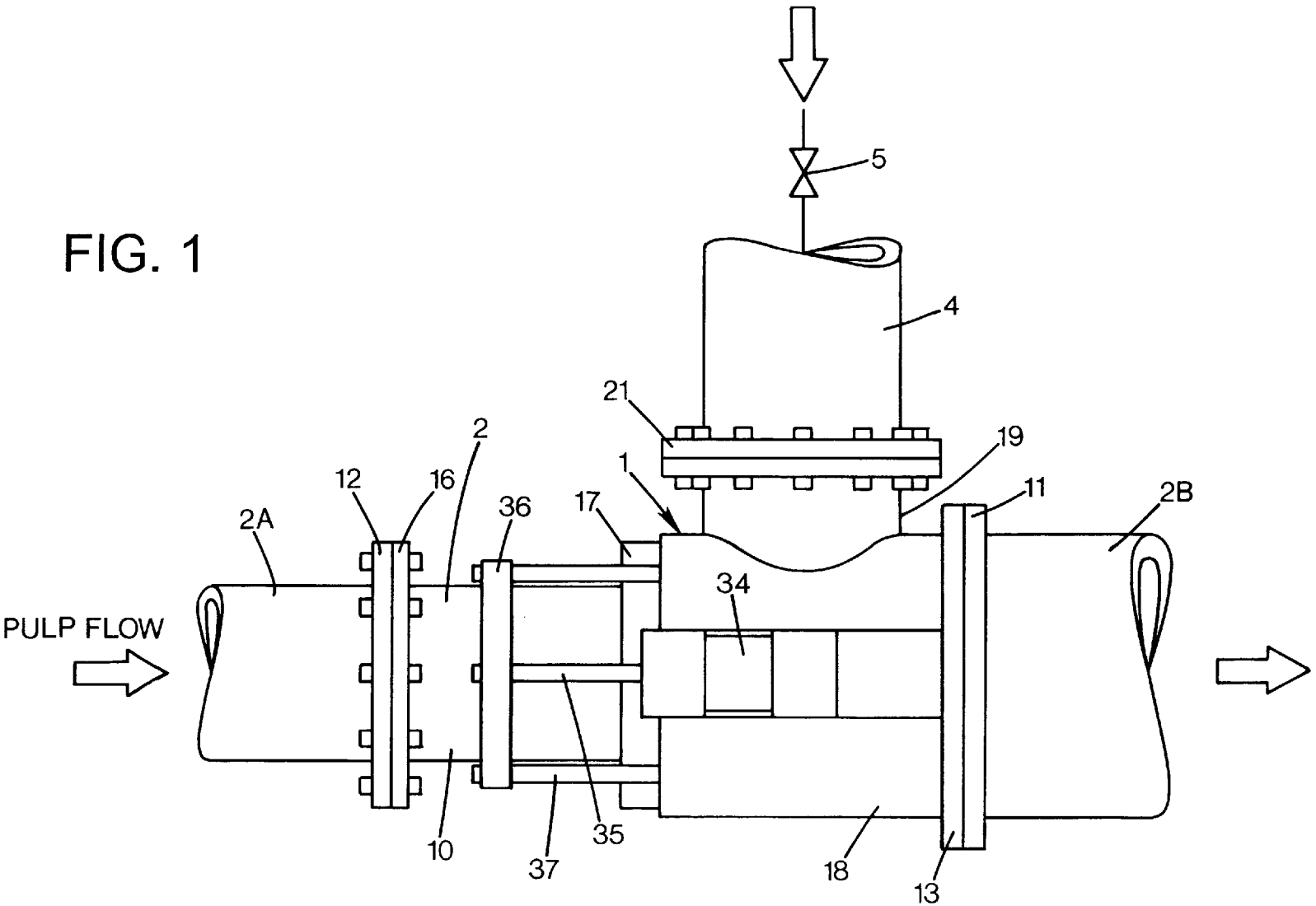
FIG. 1 shows an apparatus according to the invention mounted on a conduit.

With reference to FIG. 1, an apparatus according to the invention is generally shown with number 1. This is arranged in a conduit 2 for a pulp suspension, such as the suspension that is going to be described herein, that has an average fiber content, i.e medium consistency MC, that is a dry substance content of 5–20%, preferably 8–16%. The transport conduit extends from a MC-pump to a treatment vessel of a bleach plant that is not shown, that constitutes a peroxide step according to the example set forth. The problem that is going to be solved with the apparatus is to preheat a pulp suspension with the help of steam. The pulp suspension is in the transport conduit 1 at a temperature that is suitable for the bleaching process, such as 100° C. The transport velocity of the pulp in the conduit 2 is about 5–15 m/s. A supply line of steam under pressure to the apparatus 1 from a pressure source, that is not shown, is marked as 4. The conduit 4 has a shut off valve 5.

A central first element of the apparatus 1 is shown with 10. The first element 10 is a circular cylindrical, tube shaped element, mentioned as tube body below. The tube body has the same inner diameter as the upstream conduit 2A to which the tube body is mounted. The inner part of the tube body, defined by the inside of the wall, forms a flow-through channel for the pulp that is transported in the conduit 2. A first flange 11, and a second flange 12, respectively are used to mount the apparatus to the conduit 2. The first flange 11 cooperates with a rear wall 13 of a chamber 14 containing steam that is going to be described in more detail below. A flange 16 of the front end of the tube body 10 cooperates with the second flange 12.

The flange 11 and the wall 13, and the flange 12 and the flange 16, respectively, are joined to one another in a conventional way by a screw attachment.

Figure 2:
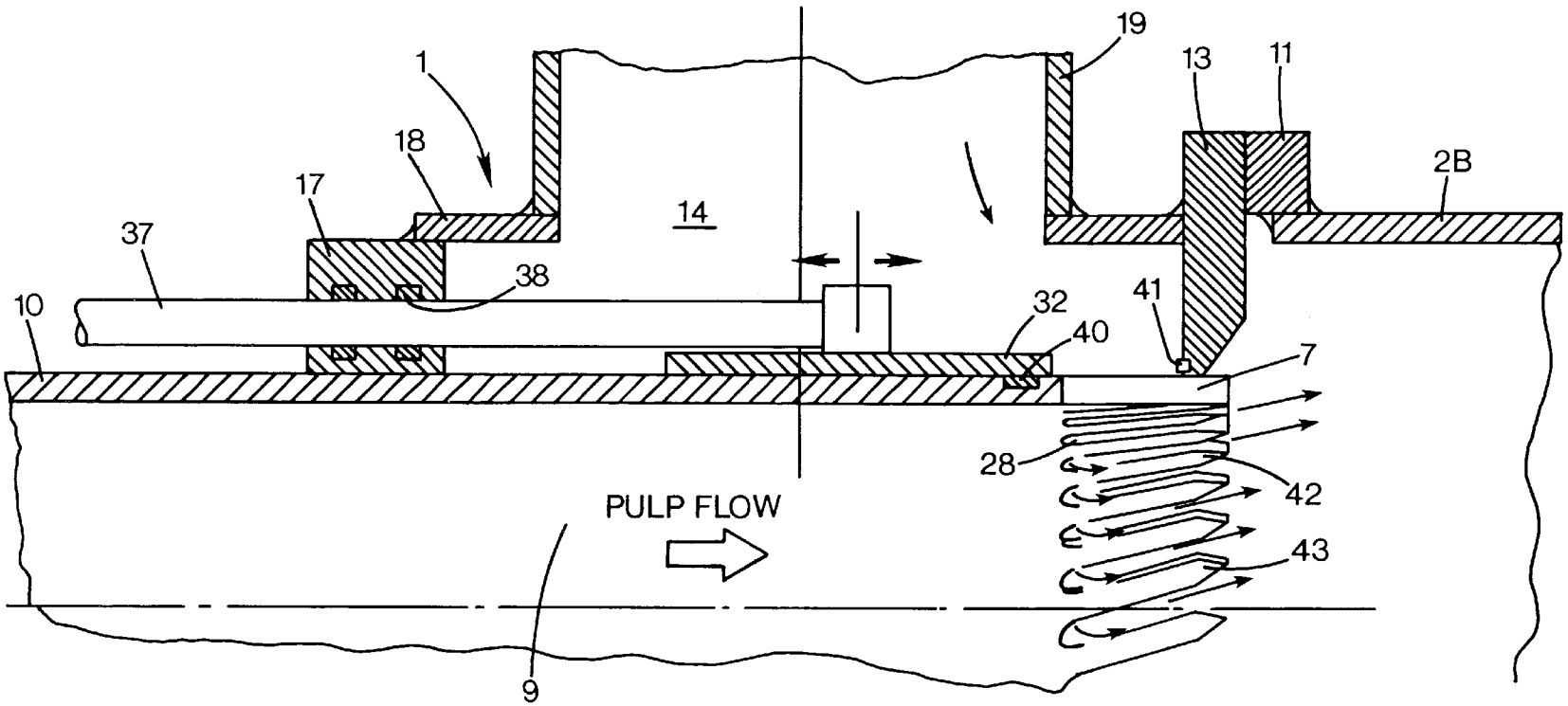
FIG. 2 shows selected parts of a side view of the apparatus, partly in a cross section with certain portions removed.

FIG. 2 shows the chamber 14 that extends about the rear and central portion of the tube body 10. It is formed by the rear end wall 13, a front, ring shaped end wall 17 and a cylindrical casing 18. The from end wall 17 is joined with both the cylindrical casing 18 and the tube body 10 by welding. Together the rear wall 13, the front wall 17 and the cylindrical casing 18 form a housing that is disposed in the surrounding chamber 14. A connection device to the chamber 14 is marked with 19. The steam conduit 4 is via a flange device, generally shown as 21, connected to the device 19 and thus to the chamber 14.

In the present example, the tube body 10 has an inner diameter of, for example, 100 mm. In the area of the rear portion of the chamber 14, the tube body 10 has slots 28 that extend through the wall of the tube body 10 and that are evenly distributed circumferentially about the tube body 10. As shown in FIG. 2, the rear edge of the slots 28 are open. Thus, the slots 28 are formed between a type of tongue that is disposed in the rear portion of the tube body 10 and are preferably milled out therefrom. Each tongue 42 has a point 43 at its end portion. This design of the slots 28 has the purpose of minimizing the risk of clogging. It also eliminates the possibility for pulp to get caught in the open rear portions of the slots. It also means that the build up of scaling is made more difficult at the pointed ends, that in combination with the abrasive effect of the pulp ensure while flowing through in the channel 9 that the slots 28 are provides a desired area of flow through.

According to the slots of the present invention, the rear edge is open (as seen in the direction of the pulp flow) and provides a rinsing effect of the slots by the added first fluid.

The tendencies of scaling that sometimes occur downstream prevents the initialization of the steam supply at the rear edge of the slots.

A sleeve shaped shield 32 matchingly bears against the tube body 10. The shield 10 is slidable from a front position, as shown in FIG. 2, where the whole area of each slit 28 is exposed and form free passages between the chamber 14 and the inside of the tube body 10, to a rear position, in which the slots 28 are closed by the shield 32. As shown in the figure, the seals 40, 41 are arranged to ensure a good seal at the rear position of the shield. (The seal 40, that seals between the shield 32 and the tube body 10, can be eliminated if a suitably good fit exits.) The seal 41 that seals against the side surface of the shield is arranged at the inner surface of the wall 13 that is an extension of the connection flange for connecting to the subsequent tube section 2. The shield 32 is adjustable even in positions between the front and the furthest rear position for exposing a suitable area of each slot 28.

In the described example, each slot has a length of about 40 mm and a width of about 8 mm. The distance between each slot is about 8 mm. Furthermore, the slots are slanted so that they form an acute angle with the flow direction of the pulp at about 30°.

A movement member provides movement of shield 32, such as an pneumatic cylinder 34 on the outside of the apparatus 1. The cylinder 34 has a piston 35 extending therethrough. This is via a joining device 36 attached to two rods 37 that extend through the end wall 17 into the chamber 14 where they are joined with the shield 32, as shown in FIG. 2. At the penetration through the end wall 17 seal rings 38 are disposed in races so that the seal rings bear against the rods 37.

The movement of the piston in the pneumatic cylinder 34 and its positioning is preferably controlled, as is described in our application 9703732-9, i.e. depending upon the temperature that is measured in the conduit 2 downstream of the apparatus 1 wherein the measured value is conveyed to an IP converter in a known way to guide the position of the piston and the piston rod 35 to control the amount of mixed in steam so that the temperature is held at a predetermined level. Normally steam at an intermediate pressure is used that maintains a pressure of about 12 bar. It is also possible to use high pressure steam at 17–18 bar and in certain cases a low pressure steam. The important part is that there is a pressure difference of at least 2 bar between the pressure in the chamber 14 and the conduit 2 and thus also in the tube body 10. This pressure difference in combination with the positioning of the shield 32 depending upon the desired steam flow enables the steam to flow through the slots 28, at a very high velocity, which ensures that the steam penetrates far into the pulp suspension that flows through the flow-through channel 9 of the tube body 10 so that an effective mixing of the steam into the pulp and thus a good heat transfer, respectively, good mixing in of other gases or liquid, is achieved. The velocity of the steam exceeds 100 m/s and normally up to or over 200 m/s.

Regardless of the position of the shield 32, the steam is thus injected into the pulp at a velocity that is optimally high at the pressure difference that exists between the available steam pressure and the pressure in the flow-through channel 9.

It is further shown that the subsequent conduit 2*b* preferably has a substantially greater diameter than the incoming conduit 2*a*. The area increase relative to the flow-through channel 9 should at least be about 50 %. As shown in FIG. 2, the area increase preferably is about 400 %. (Note that FIG. 2 shows the apparatus seen in a side view but from a different direction than FIG. 1, i.e. from behind.) According to FIG. 2, the subsequent conduit 2*b* is thus shown as having a diameter that is about twice as large as the diameter inside the flow-through channel 9. In the illustrated example, this means that the diameter of the flow through channel is 100 mm and that the subsequent conduit has a diameter of 200 mm. As shown in FIG. 2, the openings/slots 28 are located near the back edge of the flow- through channel 9. With a view to eliminate the need for a lot of material between the inner edge of the flange 13 and the tube body 10, there is a ring shaped connection device 7 at the back end of the tube body. The connection device 7 provides a seal between both the tube body 10 and the flange 13, preferably by welding. FIG. 2 shows that the distance from the front edge of the slots 28 to the back edge of the flow-through channel 9 is less than the diameter, i.e. less than 100 mm. Thanks to the sudden area increase directly after the flow-through channel 9 a turbulence is created that provides an extra mixing of the added steam so that a god and even distribution of the added heat is ensured in the pulp in the subsequent conduit 2*b*.

FIG. 1 shows that the subsequent conduit 2*b* is a separate unit relative to the apparatus 1 and is therefore the conduit to the next apparatus in the line. It is realized, though, that the turbulence zone may be a separate limited tube section or a unit that is integrated with the apparatus that preferably can be adjusted so that it can be attached to a desired subsequent conduit which normally may perhaps have the same diameter as the incoming conduit 2*a*.

The combination of the open opening/slots 28 at the back edge and the rapid area increase contributes so that the scaling problem does not lead to a reduction of the steam supply or a reduction of the actual pulp flow. A continuously high capacity of the mixing apparatus is thus provided.

It should be realized that the invention may be modified within the scope of the appended claims. It has already been mentioned that the fluids that are to be mixed may include other fluids than steam and a pulp suspension so that there are other measurements than the temperature that is to be regulated by controlling the mixing ratio of the first fluid in the second fluid. Further, many other members than a pneumatic piston cylinder may of course be used to move the shield 32 such as a hydraulic piston cylinder or an electric motor that cooperates with an adjustment mechanism etc. Furthermore, other patterns of movements than just pure axial may be used, such as screw like movements, when the shield 32 is moved.

While the present invention has been described in accordance with preferred compositions and embodiments, it is to be understood that certain substitutions and alterations may be made thereto without departing from the spirit and scope of the following claims.

The person of ordinary skill in the art may realize that tube shaped element and the conduits may have a different cross section than the above shown pure circular cylindrical such as rectangular. Further, it is realized that it is possible to use more than one connection for the supply of the fluid. It is also realized that instead of using slots, as shown above, semicircular openings may be used. Also, it is realized that the orientation of the slots may be changed to something else than the orientation shown in FIG. 2.

Additionally, it is realized that the length of the slots and width may be varied within a wide scope. The width of the slots may be provided with a progressively increasing width as seen in the flow direction. A progressively increasing width, either linearly or exponentially, provides a certain tolerance to deposits while, at the same time, the increase of deposits is counteracted.

I claim:

1. An apparatus for adding a first fluid to a second fluid, comprising:

a first conduit carrying a flow of the second fluid;

a tube-shaped element in fluid communication with the first conduit, the tube-shaped element having a flow-through channel defined therein for carrying the flow of the second fluid, the flow-through channel having a substantially constant first cross-sectional area, the tube-shaped element having a circumference and a length, the flow-through channel maintaining a first pressure;

the apparatus having a chamber defined therein, the chamber extending about a substantial portion of the circumference of the tube-shaped element and along a portion of the length of the tube-shaped element, the chamber maintaining a second pressure, the second pressure being greater than the first pressure;

a connection in fluid communication with the first fluid for supplying the first fluid to the chamber;

the tube-shaped element having a plurality of openings defined therein, the openings extending through a wall of the tube-shaped element, the openings being disposed adjacent to the chamber so that the first fluid having the second pressure in the chamber flows through the openings into the second fluid at the first pressure flowing inside the tube-shaped element, the openings having an open back edge;

a second conduit attached to the tube-shaped element and directly downstream thereof, the second conduit having a second cross-sectional area being greater than the first cross-sectional area; and a movable shield arranged on an outside of the tube shaped element, the shield being movable to control a flow volume of the first fluid into the second fluid.

2. The apparatus according to claim 1 wherein the second cross-sectional area is at least 50% greater than the first cross-sectional area.

3. The apparatus according to claim 1 wherein the second cross-sectional area is between 200% and 600% greater than the first cross-sectional area.

4. The apparatus according to claim 1 wherein the second cross-sectional area is about 400% greater than the first cross-sectional area.

5. The apparatus according to claim 1 wherein the openings are long and narrow slots.

6. The apparatus according to claim 5 wherein the slots are slanted.

7. The apparatus according to claim 1 wherein the first conduit has a circular cross section.

8. The apparatus according to claim 1 wherein the openings are formed between a plurality of tongues.

9. The apparatus according to claim 8 wherein the tongues have a substantially constant width and a length that exceeds a width of the openings.

10. The apparatus according to claim 9 wherein the length of the tongue is between 2 and 10 times the width of the openings.

11. The apparatus according to claim 9 wherein the tongues have a narrowing end portion.

12. The apparatus according to claim 11 wherein the narrowing end portion is pointed.

13. The apparatus according to claim 1 wherein a substantial number of openings are located about the tube-shaped element and within a distance from a back edge of the tube-shaped element that is less than 200 mm.

14. The apparatus according to claim 13 wherein the distance is less than 100 mm.

15. The apparatus according to claim 1 wherein the second conduit is integral with the apparatus.

16. The apparatus according to claim 1 wherein the second conduit and the apparatus are seperate parts.

* * * * *